United States Patent [19]

Radford

[11] Patent Number: 4,553,613

[45] Date of Patent: Nov. 19, 1985

[54] HYDRAULIC LIFT INNER BARREL IN A DRILL STRING CORING TOOL

[75] Inventor: Steven R. Radford, West Jordan, Utah

[73] Assignee: Norton Christensen, Inc., Salt Lake City, Utah

[21] Appl. No.: 530,492

[22] Filed: Sep. 9, 1983

[51] Int. Cl.[4] ..... E21B 25/10

[52] U.S. Cl. ..... 175/250; 175/253

[58] Field of Search ..... 175/244, 245, 247, 248, 175/249, 250, 251, 253, 58, 20, 44, 49, 387, 236, 239, 237

[56] References Cited

U.S. PATENT DOCUMENTS 2,019,176 10/1935 Dodds ..... 175/253

2,747,841 5/1956 Adamson et al. ..... 175/250

*Primary Examiner*—Stephen J. Novosad

*Assistant Examiner*—Thuy M. Bui

*Attorney, Agent, or Firm*—Beehler, Pavitt, Siegemund, Jagger & Martella

[57] ABSTRACT

An automatically operable hydraulic lift inner barrel is devised to lift the inner tube of the core barrel on a drill string. An inner mandrel is axially disposed within the outer tube of the coring tool. An outer piston which is selectively locked to the inner mandrel is telescopically and concentrically disposed about the inner mandrel. Fluid is selectively diverted from the outer tube into the inner mandrel and inside the outer piston. An inner locking piston within the inner mandrel responds to the hydraulic pressure to unlock the outer piston from the inner mandrel. The outer piston is then longitudinally displaced by the hydraulic pressure thereby lifting the inner tube which is connected to it. After the outer piston has moved a predetermined distance, the hydraulic pressure supplied to the inner mandrel and inside the outer piston reaches a second predetermined magnitude. Burst disks are then blown thereby relieving the hydraulic pressure within the outer piston inner mandrel. The inner locking piston reassumes its initial position thereby locking the inner mandrel once again to the outer piston which is now in an extended position. Therefore, an inner tube within a coring tool can be selectively lifted, moved a predetermined longitudinal distance with respect to the outer tube, and then locked into position all in an automatic operation initiation by the initial diversion of hydraulic fluid to the inner mandrel and outer piston.

18 Claims, 5 Drawing Figures

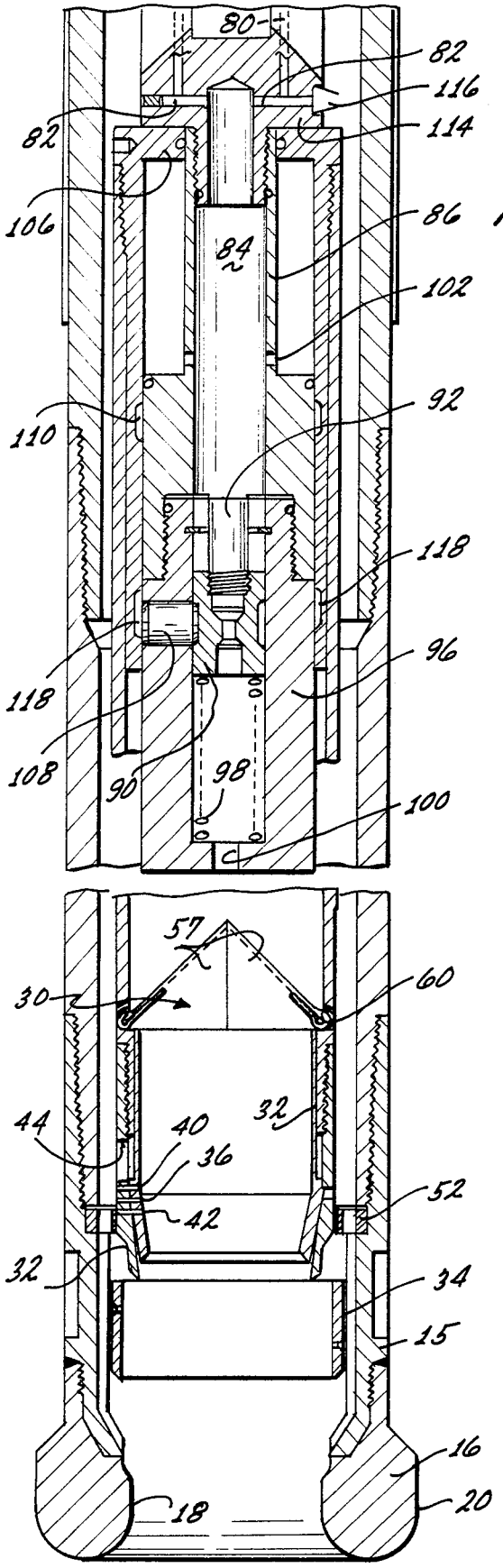
Fig. 4
Fig. 5
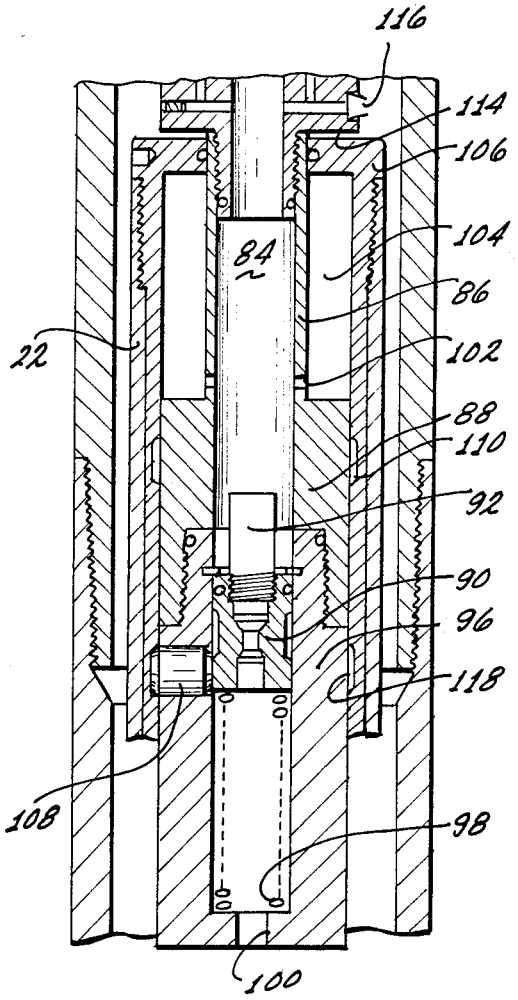

HYDRAULIC LIFT INNER BARREL IN A DRILL STRING CORING TOOL

BACKGROUND OF THE INVENTION

1. Field of the Invention

The present invention relates to the field of earth boring tools and in particular to core catchers used for retaining cores cut during coring operations.

2. Description of the Prior Art

Coring is common practice in the field of petroleum exploration and it involves a practice wherein a drill string comprised of sections of outer tube, which ultimately terminate in a coring bit, cut a cylindrical shaped core segment from the rock formation which is then cut or broken off and brought to the surface for examination. However, it is not uncommon to encounter formations which are unconsolidated, fragmented or loose. Therefore the core, after being cut, generally will not retain a rigid configuration but must be held and retained within an inner tube which is concentrically disposed within the outer tube of the drill string. Furthermore, not only must a core catcher be activated to cut and break the lower portion of the cut core from the underlying rock formation from which it was cut, but in many cases the rock formation is so unconsolidated as in the case of oil-sand, water-sand, or loose debris, that a full closure core catcher must be used to positively seal the bottom of the inner tube if the core material is to be retained within the inner tube as the drill string is lifted from the bore hole. Such core catcher enclosures are thus manipulatively operated from the surface at the end of the coring operation and prior to retrieval of the core sample. It thus becomes desirable to have some type of means within the drill string for performing these operations and others which may become necessary during coring operations or generally within drilling operations.

Therefore, what is needed is an apparatus for manipulating or lifting the inner tube within a drill string to effect retaining of the cored material during coring operations. The apparatus must be rugged, simple in operation, reliable within the drilling environment and, preferably, automatically perform its operation once selectively initiated by the platform operator.

BRIEF SUMMARY OF THE INVENTION

The invention is an apparatus for hydraulically lifting an inner tube concentrically disposed within an outer tube in a drill string comprising a first, second and third mechanism. The first mechanism selectively diverts hydraulic pressure within the outer tube in a controlled manner as described below. The second mechanism provides longitudinal displacement of the inner tube with respect to the outer tube in response to the selectively diverted hydraulic pressure from the first mechanism. The first and second mechanisms are thus in hydraulic communication with each other. The first mechanism selectively diverts hydraulic pressure to the second mechanism while the second mechanism is coupled to the inner tube. Therefore, the inner tube is longitudinally displaced by the second mechanism. The third mechanism selectively locks the second mechanism in a fixed position with respect to the outer tube. The third mechanism is also selectively provided with hydraulic pressure by the first mechanism. The third mechanism unlocks the second mechanism after a first predetermined magnitude of hydraulic pressure has been supplied to it. The second mechanism then longitudinally displaces the inner tube as recited above by a predetermined distance. The first mechanism then selectively rediverts the hydraulic pressure away from the second and third mechanisms when a second predetermined magnitude of hydraulic pressure is achieved. The third mechanism then unlocks the second mechanism with respect to the outer tube in a second configuraion so that the inner tube is selectively lifted with respect to the outer tube in an automatic fashion by activation of the first mechanism to selectively divert the hydraulic pressure.

BRIEF DESCRIPTION OF THE DRAWINGS

FIG. 4 is a cross-sectional view of the drill string of FIG. 2 at a third stage of operation.

FIG. 5 is a cross-sectional view in enlarged scale of a portion of the drill string of FIG. 2 in its final stage of operation.

The present invention including its mode and manner of operation is better understood by considering the above Figures in light of the following detailed description.

DETAILED DESCRIPTION OF THE PREFERRED EMBODIMENTS

The invention is an externally powered core catcher capable of capturing cut cores in unconsolidated and loose formations in a manner such that the core, when cut, is undisturbed. The externally powered core catcher includes a modified conventional core catcher which is slidable within the end portion of the core barrel according to means described in greater detail below. The slidable, conventional core catcher is externally actuated to grip and seize a core which is fully disposed within the core barrel. However, activation of the core catcher is, as stated, external and is not dependent upon any type of co-action with the core. In the case of an unconsolidated core, such a conventional core catcher, even when externally activated, may often fail to prevent loss of the unconsolidated core from the barrel. Therefore, also according to the invention, the slidable core catcher co-acts with a biased, full-closure core catcher which acts as a check valve to completely close off and seal the core barrel in the case of soft or unconsolidated formations. The manner in which the slidable core catcher is externally powered and its co-action with the full closure core catcher can be better understood by now turning to consider in detail the illustrated embodiment.

Figure 1:
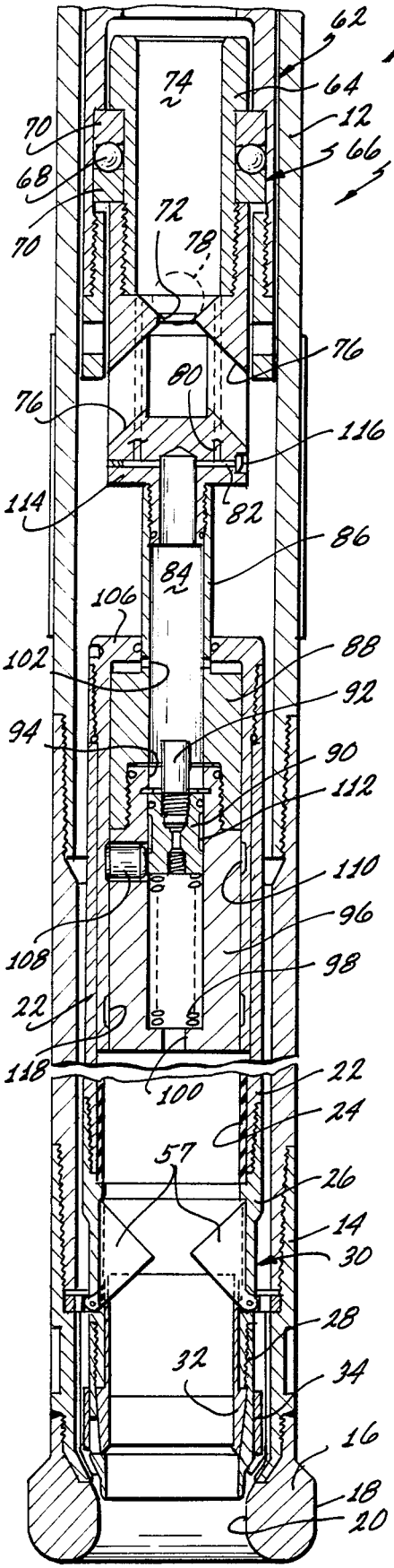
FIG. 1 is a longitudinal sectional view of a drill string used in a coring operation which incorporates the invention.

Turn now to FIG. 1 which is a broken cross-sectional view of a portion of a drill string as used in coring operations, which drill string incorporates the invention. The drill string, generally denoted by reference numeral 10, includes an outer tube 12, which in turn may include a plurality of threadably coupled subsections or outer tube subs. Outer tube 12 is threadably coupled in a conventional manner to a coring bit 14.

Coring bit 14 in turn includes a bit crown 16 which provides the operative cutting action when rotated. In the present embodiment, a rotating diamond bit is shown, although the invention is not limited to just diamond rotating bits. Any coring bit could be used in combination with the invention. Bit crown 16 defines the inner diameter of the bore hole by the diameter of outer gage 18, and defines the outer diameter of the core by inner gage 20. For the sake of clarity, the bore hole and the core have been omitted so that the elements of the invention can be more clearly depicted. However, bit crown 16 will cut a core in conventional manner which will be fed upwardly within an inner tube 22. In the illustrated embodiment inner tube 22 is also provided with a plastic liner 24 at its lower end which liner 24 is removable with the core for ease of handling. When the core is retrieved to the surface of the hole, plastic liner 24 is removed from inner tube 22, capped at each end or cut into sections and capped for transportation to a petroleum laboratory for testing.

As illustrated in each of the Figures, inner tube 22 is threadably connected at its lower end to an upper inner tube shoe 26. Inner tube shoe 26 in turn is threadably coupled to a bottom inner tube shoe 28. A full closure core catcher, described in greater detail below and generally denoted by reference numeral 30 and a slidable core catcher 32 are disposed within inner tube shoe 26 and bottom inner tube shoe 28. The full closure core catcher is described in application Ser. No. 530,520 filed Sept. 09, 1983, assigned to the same assignee of the present application.

Figure 2:
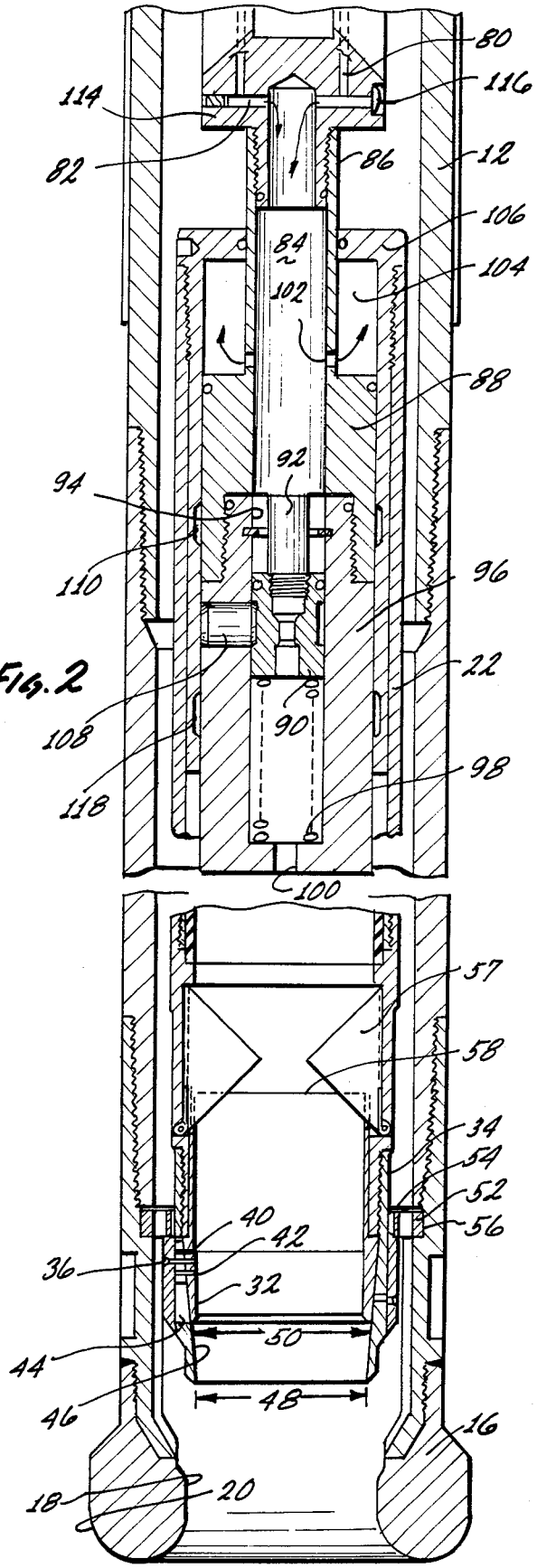
FIG. 2 is a cross-sectional view in enlarged scale of a portion of the drill string of FIG. 1 at a first stage of operation of the core catcher.

Consider first slidable core catcher 32. Slidable core catcher 32 is substantially similar to a conventional core catcher with the exception that slidable core catcher 32 is longitudinally translatable within inner tube shoe 26 and bottom inner tube shoe 28 in a direction parallel to the longitudinal axis of shoes 26 and 28 or equivalently inner tube 22. As shown in FIG. 2 slidable core catcher 32 is pinned to inner tube shoe ring 34 by means of second set of shear pins 36. A first set of shear pins 38, diametrically opposed to second shear pin 36 serves to connect inner tube shoe ring 34 to bottom inner tube shoe 28. Shear pins 36 and 38 are best seen in FIGS. 2–5. Slidable core catcher 32 is also connected by means of belt 40 to shoe slip 42. Shoe slip 42 is longitudinally slidable within a longitudinal slot 44 defined through bottom inner tube shoe 28. Thus, slidable core catcher 32 may move longitudinally relative to bottom inner tube shoe 28 by virtue of the longitudinal displacement of shoe slip 42 within slot 44 defined through bottom inner tube shoe 28 after ring 34 is released from tube shoe 28.

As illustrated in each of the Figures, bottom inner tube shoe 28 includes a conical inner surface 46 characterized by a first diameter 48 at its lower end, nearest bit crown 16, and a second larger diameter 50 at the end of the bore formed within inner tube shoe 28 at a point longitudinally displaced away from bit crown 16. Therefore, as slidable core catcher 32 moves longitudinally with respect to inner tube shoe 28, as will be described in greater detail below, slidable core catcher 32 will be squeezed by the smaller diameter of conical surface 46 of inner tube shoe 28 thereby causing core catcher 32 to compress and to grip the core which has been cut and fed upwardly into inner tube 22. In the case where the core is hard, slidable core catcher 32 will thus operate in a conventional manner to grip and catch the core within inner tube 22.

Consider now the means by which slidable core catcher 32 is longitudinally displaced with respect to inner tube shoe 28. When the core barrel is lifted from the well hole, inner tube 22 will be longitudinally pulled upwardly by means described in greater detail below. At first, inner tube shoe ring 34 is rigidly connected by first shear pin 38 to inner tube shoe 28 and therefore the entire assembly, including core catcher 32, moves upwardly with inner tube 22 while outer tube 12, including bit crown 16, remains longitudinally stationary.

Turn now to FIG. 2 which illustrates a situation wherein inner tube 22 has been lifted by a predetermined distance sufficient to bring the top surface of inner tube shoe ring 34 against an outer tube ring 52. Outer tube ring 52, which may include a plurality of hydraulic bypass ports 54 defined therethrough, is longitudinally fixed to outer tube 12. In particular, outer tube ring 52 is set within a counterbore 56 defined within coring bit 15 and is wedged in place by the butt end 58 of the lowermost section of outer tube 12.

When, as in FIG. 2, inner tube shoe ring 34 contacts outer tube ring 52, a transverse stress is applied to first shear pin 38 by the force urging inner tube 22 upwardly. First shear pin 38 is designed to shear at a predetermined transverse stress. When first shear pin 38 fails, inner tube shoe ring 34 is disconnected from inner tube shoe 28. As inner tube 22 and ultimately inner tube shoe 28 continue to be pulled upwardly, inner tube shoe ring 34 is retained in its relative longitudinal position with respect to outer tube 12 by outer tube ring 52. Inner tube shoe ring 34 thus pulls slidable core catcher 32 downwardly within slot 44 as inner tube 22 continues its upward movement. As described, the downward motion of core catcher 32 within conical surface 46 of inner tube shoe 28 will cause core catcher 32 to grasp the core.

Ultimately, inner tube 22 will have moved upwardly by an amount equal to the longitudinal distance of slot 44 and shoe slip 42 will thus be at the bottom of slot 44. This configuration is illustrated by the cross-sectional view of FIG. 3. As is clearly evident in FIG. 3, inner tube shoe ring 34, has during the entire operation and continuing to the situation depicted in FIG. 3, remained in contact with outer tube ring 52. As inner tube 22 continues to be urged upwardly, a transverse stress will then be applied to second shear pin 36. Again at a predetermined magnitude of stress, second shear pin 36 will fail thereby decoupling core catcher 32 from inner tube shoe ring 34. Inner tube 22 including core catcher 32 which is now tightly jammed near or in diameter 48 of inner tube shoe 28 are then freed for continued upward movement of inner tube 22.

Figure 3:
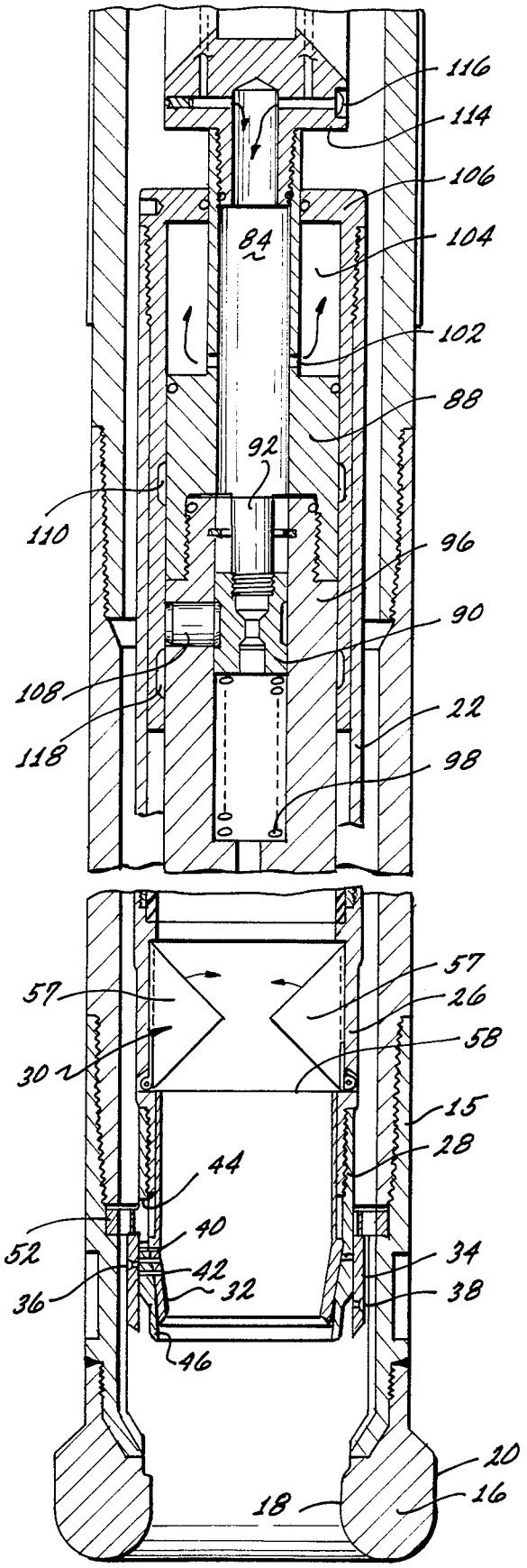
FIG. 3 is a cross-sectional view of the drill string of FIG. 2 at a second stage of operation of the core catcher.

However, as depicted in FIG. 3, when core catcher 32 has reached the bottom of slot 44, the opposing end 58 of core catcher 32 has just cleared the bottom edge of full closure core catcher 30. Full closure core catcher 30 is divided into a plurality of segments 57, two of which are shown in elevational view in the Figures. The segments of full closure core catcher 30 form a cusp-shaped check valve which is closable across the inner diameter of inner tube 22. Segments 57 of full closure core catcher 30 may be cut, cast or forged to appoximate the inner diameter of inner tube shoe 26. Each segment 57 includes a hinge 60 at the lower end of segment 57, which hinge 60 is connected to inner tube shoe 26 and provides an axis of rotation for the corresponding segment, which axis is substantially tangential to the inner surface of inner tube shoe 26. Thus, each segment 57, is able to rotate about its corresponding hinge 60 toward the center of inner tube shoe 26 to there mate with a corresponding opposing segment or segments 57 to form a full closure cusped check-valve. In the illustrated embodiment of two to four segments 57 are used to provide a complete closure of inner tube shoe 26. Segments 57, when closed, remain at an angle with respect to the longitudinal axis of the drill string and of inner tube shoe 26. Again, in the illustrated embodiment, when in the closed configuration, segments 57 form a conically shaped closed surface having a cone angle of 30° to 45° with respect to the longitudinal axis of inner tube shoe 26.

Turning to FIG. 3, it should be particularly noted that full closure core catcher 30 cannot close until slidable core catcher 32 has been longitudinally displaced by a sufficient distance so that end 58 clears the lowermost portion of full closure core catcher 30. In the illustrated embodiment, each hinge 60 is provided with a torsion spring which tends to urge its corresponding segment 57 inwardly into the fully closed position. In addition, any downward movement of the core within inner tube shoe 26 will cause the inclined segments of full closure core catcher 30 to dig into the core and rotate to the closed position. Clearly, in the case where a hard core is taken, full closure core catcher 30 will not be able to rotate inwardly, nor serve to catch the core within inner tube 22. However, in the case of hard cores, slidable core catcher 32 is adequate to catch the core within the barrel. In the case of soft and unconsolidated cores, slidable core catcher 32 cannot obtain a grip or bite on the core which would simply fall through core catcher 32. In that case, when core catcher 32 has moved downwardly as shown in FIG. 3, full closure core catcher 30 will be activated by the biased spring at each hinge 60 and full closure core catcher 30 will close into the soft formation and completely seal inner tube 36 and retain all core material lying above catcher 30 within inner tube 22. Any downward movement of the soft core only tends to seal and close full closure core catcher 30 more tightly.

At this point, the core is retained within inner tube 22 either by core catcher 32, full closure core catcher 30, or both, and the entire drill string can then be removed from the bore hole, disassembled, and the cut core retrieved. Throughout the above discussion it has been assumed that there is some means which pulls inner tube 22 upwardly to activate the sequence of operations described. A number of means may be employed for longitudinally displacing inner tube 22, and inner tube shoes 26 and 28 by a sufficient distance and with sufficient force to effect the operation disclosed. However, in the preferred embodiment, inner tube 22 is activated by a hydraulic lift described below.

Turn again to FIG. 1 and in particular note the upper portion of the drill string illustrated therein. Beginning at the top, outer tube 12 is connected in a conventional manner to a conventional bearing assembly 62. The connection between bearing assembly 62 and outer tube 12 has been omitted for the sake of clarity in FIG. 1. As is well known in the art, bearing assembly 62 is simply threadably connected to or splined to an inside mating surface (not shown) provided in outer tube 12.

The upper portion of bearing assembly 62 is rotatably coupled to bearing retainer 64 which is axially disposed within bearing assembly 62. Coupling of bearing retainer 64 with bearing assembly 62 is by means of a conventional ball bearing thrust bearing, generally denoted by reference numeral 66. Thrust bearing 66 includes ball bearings 68 carried in an upper and lower raceway 70.

Bearing retainer 64 includes a port 72 defined within its lower portion. Port 72 provides the primary means by which hydraulic fluid flows through the outer tube 12 into a chamber 74 axially defined within the upper portion of bearing retainer 64. Hydraulic fluid or drilling mud flows through port 72 and out of bearing retainer 64 through primary radial ports 76. The hydraulic fluid continues to flow downwardly within outer tube 12, and outside of inner tube 22 to inner gage 20 of core bit 15.

However, when it is desired to longitudinally displace inner tube 22 with respect to outer tube 12 in the manner as described above, a solid check ball 78 is dropped into the hydraulic flow flowing downwardly within the drill string. Ball 78 ultimately comes to rest within port 72 in the manner depicted in FIG. 1. Check ball 78 is of sufficient diameter that it effectively closes and jams into port 72 of bearing retainer 64. Hydraulic fluid can thus no longer pass through its primary path through port 72 and radial ports 76. Instead, hydraulic fluid is now forced through longitudinal passages 80 defined within bearing retainer 64. Longitudinal passages 80 communicate with transverse passage 82. Hydraulic fluid is thus forced through transverse passage 82 into axial chamber 84 defined within the longitudinal extension 86 of an inner mandril 88.

Pressure then begins to build up within axial chamber 84 against the top surface of inner locking piston 90. Inner locking piston 90 includes a check valve 92 axially disposed therethrough. However, check valve 92 is a one way valve which only permits upward flow of hydraulic fluid. Inner locking piston 90 is, as illustrated in the Figures, disposed within an axial chamber 94 defined within a bottom end inner mandrel 96 which, in turn, is threadably coupled to top end inner mandrel 88. Axial chamber 94 is concentric with axial chamber 84 within top end inner mandrel 88. Inner locking piston 90 is biased within chamber 94 by a compression spring 98 bearing at one end against the bottom end of inner locking piston 90 and bearing at its other end against the termination of axial chamber 94 defined within bottom end inner mandrel 96. Axial chamber 94 is communicated with the interior of inner tube 22 by means of a venting port 100 which allows the pressure behind inner locking piston 90 to always be relieved.

Meanwhile, after check ball 78 has seated, pressure continues to build on the top of inner locking piston 90 thereby compressing piston 90 against spring 98 and driving piston 90 downwardly within axial chamber 94. However, at the same time, hydraulic pressures is provided through radial ports 102 defined through longitudinal tube 86 into an innerlying space 104 between the top surface of top end inner mandrel 88 and an outer piston 106. Outer piston 106 is, however, connected through movable locking dog 108 to the upper end of inner mandrel 96. Therefore, outer piston 106 cannot move relative to mandrel 88 or 96 as long as it is locked by locking dog 108, but applies an upward force against locking dog 108. The circumferential edges of locking dog 108 are chamfered as are the edges of indentations 110 radially defined into the inner surface of outer piston 106. The engagement of locking dog 108 into the mating indentation 110 is in fact the means by which outer piston 106 is locked with respect to bottom end inner mandrel 96.

However, when sufficient pressure has been created to move piston 90 against spring 98 by distance sufficient to align mating indentation 112, radially defined within inner piston 90, with locking dog 108, dog 108 will be forced out of indentation 110 of outer piston 106 and into indentation 112 defined in inner piston 90. At this point, outer piston 106 is free to move upwardly with respect to bottom end inner mandrel 96 and top end inner mandrel 88.

As outer piston 106 begins to move longitudinally upward as shown in FIGS. 2 and 3, it carries inner tube 22 with it, which is threadably connected to it. The upward longitudinal motion of outer piston 106, carrying inner tube 22, is the lifting force which activates full closure catcher 30 and slidable core catcher 32 in the manner described above.

Outer piston 106 continues to move upwardly until it reaches the configuration illustrated in FIG. 4. At that point outer piston 106 is restrained from further longitudinal movement by a juxtapositioned bottom shoulder 114 of bearing retainer 64. Hydraulic pressure, which has been moderated by the expansion of outer piston 106 now begins to increase again. At a predetermined pressure, a burst disk 116 disposed in the outer radial end of one of the transverse passages 82 will fail as indicated in FIG. 4. Therefore, hydraulic fluid being supplied through longitudinal passages 80 to transverse passage 82 will be vented through the radial opening, previously sealed by disk 116, and will be emptied into the low pressure interior of outer tube 12.

At this time the hydraulic pressure within axial chamber 84 and 94 begins to decrease. As shown in FIG. 4, outer piston 106 is also provided with a radial indentation 118 at its lower end which is also adapted to mate with the corresponding outer radial surface of locking dog 108. However, when outer piston 106 has reached its full expansion and is in contact with shoulder 114 of bearing retainer 64, indentations 118 will have moved upwardly and past locking dog 108 by approximately one-quarter of an inch. When the pressure begins to decrease by the bursting of disk 116, outer piston 106 will begin to fall downwardly under the action of its own weight. However, at the same time, piston 90 is urged upwardly by spring 98 and indentation 112 within piston 90 begins to urge locking dog 108 radially outward. However, because of the misalignment between locking dog 108 and indentation 118 when in the configuration shown as FIGS. 3 and 4, locking dog 108 is unable to move radially outward.

However, as the pressure decreases, outer piston 106 will begin to move downwardly under its own weight. After it has moved downwardly by approximately one-quarter of an inch, locking dog 108 will be forced outwardly into indentations 118, which are now aligned, thereby allowing piston 90 under the urging of spring 98 to move to the fully extended position as shown in FIG. 5. Once again, outer piston 106 is longitudinally locked with respect to bottom end inner mandrel 96. This mutual locking between mandrel 96 and piston 106, of course, means that inner tube 22, which is connected to outer piston 106 is longitudinally fixed with respect to outer tube 12. Outer tube 12 is ultimately connected through bearing 62, 64, longitudinal tube 86 and top end inner mandrel 88 to bottom end inner mandrel 96. Therefore, the operative closure of core catcher 32 and full closure core catcher 30 are maintained in a locked position even after all hydraulic pressure has been removed.

Many modifications and alterations may be made by those having ordinary skill in the art without departing from the spirit and scope of the invention. For example, returning to the disclosed configuration of full closure core catcher 30, catcher 30 has been shown in the illustrated embodiment as rotatably connected to inner tube shoe 26. However, it is entirely within the scope of the present invention that full closure core catcher 30 could be positioned elsewhere within the drill string, such as within the core bit shank and need not run on inner tube shoe 26. In this configuration, inner tube shoe 28 would be lifted upwardly in the same manner as before and after the lower end of inner tube shoe 28 had cleared the upper end of the full closure core catcher mounted in the coring bit shank, the full closure core catcher would then be free to close in substantially the same manner as described above in the illustrated embodiment.

Therefore, the illustrated embodiment must be understood as being described only for the purposes of clarity and example. It is not intended that the illustrated embodiment serve as a limitation of the invention which is defined in the following claims.

I claim:

1. An apparatus for hydraulically lifting an inner tube concentrically disposed within an outer tube in a drill string comprising:

first means for selectively and automatically diverting hydraulic flow within said outer tube;

second means for providing longitudinal upward displacement of said inner tube in response to said selectively diverted hydraulic flow, said first means selectively diverting hydraulic flow to said second means and said second means being coupled to said inner tube wherein said inner tube is longitudinally displaced upward by said second means; and third means for selectively locking said second means in a fixed position with respect to said outer tube, said third means also being selectively provided with hydraulic flow by said first means, said third means for automatically unlocking said second means after a first predetermined magnitude of hydraulic pressure has been supplied to said second and third means, said second means then longitudinally displacing said inner tube upward with respect to said outer tube by a predetermined distance, said first means then for selectively and automatically rediverting said hydraulic flow when a second predetermined magnitude of said pressure is achieved, said third means then locking said second means with respect to said outer tube in a second relative configuration thereto, whereby said inner and outer tube may be selectively longitudinally displaced with respect to each other in an automatic fashion by activation of said first means.

2. An apparatus for hydraulically lifting an inner tube concentrically disposed within an outer tube in a drill string comprising:

first means for selectively diverting hydraulic flow within said outer tube;

second means for providing longitudinal displacement of said inner tube in response to selectively diverted hydraulic flow, said first means selectively diverting hydraulic flow to said second means and said second means being coupled to said inner tube wherein said inner tube is longitudinally displaced by said second means; and third means for selectively locking locking said second means in a fixed position with respect to said outer tube, said third means also being selectively provided with hydraulic flow by said first means, said third means unlocking said second means after a first predetermined magnitude of hydraulic pressure has been supplied to said second and third means, said second means then longitudinally displacing said inner tube with respect to said outer tube by a predetermined distance, said first means then selectively rediverting said hydraulic flow away from said second and third means when a second predetermined magnitude of pressure is achieved, said third means then locking said second means with respect to said outer tube in a second relative configuration thereto, whereby said inner and outer tube may be selectively longitudinally displaced with respect to each other in an automatic fashion by activation of said first means, wherein said first means includes a bearing assembly disposed within said outer tube and connected to said third means and further includes a selectively closable hydraulic port defined within said bearing assembly and a bypass port coupling hydraulic pressure to said second and third means when said port is selectively closed.

3. The apparatus of claim 2 wherein said second means is a piston longitudinally disposed within said outer tube and longitudinally displaceable with respect to said bearing assembly, said inner tube being connected to said piston.

4. The apparatus of claim 3 wherein said third means for selectively locking said second means with respect to said outer tube includes a resiliently biased locking piston longitudinally displaceable by said hydraulic pressure, said third means including locking means responsive to said locking piston wherein a predetermined longitudinal displacement of said locking piston responsive to said hydraulic pressure activates said locking means to unlock said piston of said second means from its fixed position with respect to said third means, said third means being fixed relative to said outer tube.

5. The apparatus of claim 4 wherein said locking means comprises a locking dog normally engaging a mating recess defined in said piston of said second means, said locking dog being longitudinally fixed with respect to said outer tube whereby engagement between said locking dog and said piston of said second means fixes the longitudinal position of said piston of said second means with respect to said outer tube, said locking dog being disengaged from said piston of said second means by disposition of said locking dog within a mating recess defined in said locking piston of said third means, said mating recess within said locking piston of said third means being alignable with said locking dog thereby allowing said locking dog to be disposed therein after said biased locking piston of said third means has been longitudinally displaced by a predetermined distance in response to a correspondingly predetermined first magnitude of said hydraulic pressure.

6. An apparatus in a drill string for longitudinally displacing an inner tube, concentrically displaced within an outer tube, between a first and second locked configuration of said inner and outer tubes, comprising:

first means for locking said inner and outer tube in said first configuration;

second means for selectively unlocking said inner and outer tube from each other;

wherein said first means for locking said inner and outer tube in said first configuration comprises an unbiased locking dog longitudinally fixed with respect to said outer tube and engaging said inner tube to longitudinally fix said inner tube with respect to said outer tube in said first configuration, said dog having a bevelled surfaced engaging a mating bevelled surfaced of said inner tube whereby a radial force is exerted on said dog to displace said dog inwardly when said inner and outer tubes are longitudinally displaced with respect to each other;

wherein said second means for selectively unlocking said inner tube with respect to said outer tube comprises a biased inner locking piston responsive to hydraulic pressure, said inner locking piston arranged and configured to receive said locking dog after said inner locking piston has been longitudinally displced by a predetermined distance in response to a corresponding predetermined magnitude of said hydraulic pressure, said locking dog disengaging said inner tube when received within said inner locking piston;

third means for longitudinally displacing said inner tube with respect to said outer tube, wherein said third means comprises an outer piston coupled to said inner tube, which is longitudinally displaceable within said outer tube, said outer piston being responsive to said hydraulic pressure and longitudinally displaced from said first to second configuration after said locking dog has disengaged from said inner tube; and fourth means for selectively providing hydraulic pressure to said apparatus until a predetermined magnitude of pressure is achieved when said outer piston has assumed said second configuration, said fourth means then automatically removing said hydraulic pressure from said apparatus.

7. The apparatus of claim 6 further comprising fifth means for locking said inner tube in said second configuration when said hydraulic pressure is removed from said inner locking piston by said fourth means after said outer piston has assumed said second configuration, said inner locking piston responsive to said release of said hydraulic pressure to force said locking dog into engagement with said inner tube thereby locking said inner tube into said second configuration with respect to said outer tube.

8. An apparatus in a drill string for longitudinally displacing an inner tube, concentrically displaced within an outer tube, between a first and second locked configuration of said inner and outer tubes, comprising:

first means for locking said inner and outer tube in said first configuration;

second means for selectively unlocking said inner and outer tube from each other;

wherein said first means for locking said inner and outer tube in said first configuration comprises a locking dog longitudinally fixed with respect to said outer tube and engaging said inner tube to longitudinally fix said inner tube with respect to said outer tube in said first configuration;

wherein said second means for selectively unlocking said inner tube with respect to said outer tube comprises a biased inner locking piston responsive to hydraulic pressure, said inner locking piston arranged and configured to receive said locking dog after said inner locking piston has been longitudinally displaced by a predetermined distance in response to a corresponding predetermined magnitude of said hydraulic pressure, said locking dog disengaging said inner tube when received within said inner locking piston;

third means for longitudinally displacing said inner tube with respect to said outer tube wherein said third means comprises an outer piston coupled to said inner tube and longitudinally displaceable within said outer tube, said outer piston being responsive to said hydraulic pressure and longitudinally displaced from said first to second configuration after said locking dog has disengaged from said inner tube;

fourth means for selectively providing hydraulic pressure to said apparatus until a predetermined magnitude of pressure is achieved when said outer piston has assumed said second configuration, said fourth means then removing said hydraulic pressure from said apparatus;

wherein said fourth means comprises:

a primary port disposed within said outer tube, hydraulic fluid forced through said outer tube flowing through said primary port to a space defined between said outer and inner tubes;

bypass passages for communicating hydraulic fluid and pressure to inside said outer piston and on said inner locking piston;

a check ball selectively disposed within said outer tube, said check ball arranged and configured to mate with said primary port and to substantially seal said primary port when disposed therein to force said hydraulic fluid into said bypass passages thereby raising said hydraulic pressures inside said outer piston to said predetermined magnitude; and burst means communicating with said bypass passages, said burst means for releasing said hydraulic fluid and pressure from said outer piston when said hydraulic pressure has exceeded said predetermined magnitude.

9. A hydraulic lift apparatus for use in combination with a drill string and coring bit, said drill string being characterized by including an outer tube connected to a coring bit and having pressurized hydraulic fluid forced through said outer tube, said drill string further characterized by an inner tube for receiving and lifting a core cut by said core bit, said hydraulic fluid generally flowing beetween said outer and inner tube to said core bit, said hydraulic lift apparatus comprising:

an inner mandrel longitudinally fixed and coupled to said outer tube and concentrically disposed within said outer tube;

an outer piston disposed within said outer tube and concentrically disposed in telescopic relationship about said inner mandrel, said outer piston being selectively, longitudinally fixed with respect to said inner mandrel and hence said outer tube, said outer piston being connected to said inner tube; and first means for providing hydraulic and static pressure to said outer piston;

second means for unlocking said outer piston with respect to said inner mandrel; and third means for automatically longitudinally displacing said outer piston upwardly with respect to said inner mandrel to seize said core and thence to lift said inner tube, said outer piston being displaced by said static pressure provided by said first means;

whereby said hydraulic lift apparatus is included within said drill string for selectively lifting said inner tube within said drill string to facilitate coring.

10. A hydraulic lift apparatus for use in combination with a drill string and coring bit, said drill string being characterized by including an outer tube connected to a coring bit and having pressurized hydraulic fluid forced through said outer tube, said drill string further charaterized by an inner tube for receiving and lifting a core cut by said core bit, said hydraulic fluid generally flowing between said outer and inner tube to said core bit, said hydraulic lift apparatus comprising:

an inner mandrel longitudinally fixed and coupled to said outer tube and concentrically disposed within said outer tube;

an outer piston disposed within said outer tube and concentrically disposed in telescopic relationship about said inner mandrel, said outer piston being selectively, longitudinally fixed with respect to said inner mandrel and hence said outer tube, said outer piston being connected to said inner tube; and means for providing hydraulic fluid and pressure to said outer piston and for unlocking said outer piston with respect to said inner mandrel to thereby longitudinally displace said outer piston with respect to said inner mandrel, and thence to lift said inner tube, wherein said inner mandrel is coupled to said outer tube and longitudinally fixed thereto to a bearing assembly, said bearing assembly having a first portion connected to said outer tube and a second portion rotatable with respect to said first portion, said second portion of said bearing assembly being connected with said inner mandrel whereby said inner mandrel is rotatable with respect to said outer tube while being longitudinally fixed with respect thereto, whereby said hydraulic lift apparatus is included within said drill string for selectively lifting said inner tube within said drill string to facilitate coring.

11. A hydraulic lift apparatus for use in combination with a drill string and coring bit, said drill string being characterized by including an outer tube connected to a coring bit and having pressurized hydraulic fluid forced through said outer tube, said drill string further characterized by an inner tube for receiving and lifting a core cut by said core bit, said hydraulic fluid generally flowing between said outer and inner tube to said core bit, said hydraulic lift apparatus comprising:

an inner mandrel longitudinally fixed and coupled to said outer tube and concentrically disposed within said outer tube;

an outer piston disposed within said outer tube and concentrically disposed in telescoping relationship about said inner mandrel, said outer piston being selectively, longitudinally fixed with respect to said inner mandrel and hence said outer tube, said outer piston being connected to said inner tube; and means for providing hyudraulic fluid and pressure to said outer piston and for unlocking said outer piston with respect to said inner mandrel to thereby longitudinally displace said outer piston with respect to said inner mandrel and thence to lift said inner tube, wherein said means for providing hydraulic fluid and pressure and for selectively unlocking said outer piston with respect to said inner mandrel comprises:

means for diverting hydraulic fluid and pressure to said inner mandrel and inside said outer piston; and an inner locking piston disposed within said inner mandrel and responsive to hydraulic fluid and pressure applied thereto to unlock said inner mandrel from said inner piston, said outer piston then being responsive to hydraulic fluid and pressure supplied to inside said outer piston to be longitudinally displaced with respect to said inner mandrel thereby lifting said inner tube connected to said outer piston upwardly within said outer tube, whereby said hydraulic lift apparatus is included within said drill string for selectively lifting said inner tube within said drill string to facilitate coring.

12. The hydraulic lift apparatus of claim 11 wherein said inner locking piston is longitudinally displaceable within said inner mandrel within an axial bore defined therein, said inner locking piston resiliently biased to assume a first position and responsive to said hydraulic fluid and pressure to assume a second position, said inner locking piston further comprising a locking dog slidably disposed in a radial bore defined through said inner mandrel, said locking dog engaging said outer piston when said inner locking piston is in said first position to longitudinally fix said outer piston to said inner mandrel, said locking dog disengaging said outer piston when said inner locking piston assumes said second position, said locking dog being received within a mating indentation defined within said inner locking piston when said inner locking piston is in said second position, thereby allowing said disengagement of said locking dog from said outer piston and permitting said outer piston to become longitudinally displaced in response to hydraulic fluid and pressure provided inside said outer piston.

13. The hydraulic lift apparatus of claim 12 further comprising means for removing hydraulic fluid and pressure from said axial bore of said inner mandrel and from inside said outer piston, after said outer piston has been longitudinally displaced by a predetermined distance.

14. The hydraulic lift apparatus of claim 13 wherein said outer piston includes a second indentation defined therein for engagement with said locking dog, said locking dog radially disposable within said second indentation after said hydraulic fluid and pressure has been removed from said inner locking piston within said inner mandrel and from inside said outer piston, thereby allowing said second indentation and locking dog to be aligned and allowing said inner locking piston to resiliently reassume said first position, thereby forcing and securing said locking dog into said second indentation of said outer piston.

15. The hydraulic lift apparatus of claim 13 wherein:

said means for providing hydraulic fluid and pressure to said inner mandrel and inside said outer piston comprises at least one bypass passage communicating with hydraulic fluid flowing through said outer tube at one end of said passage, communicating with said axial bore defined in said inner mandrel and with the space inside said outer piston defined between said outer piston and inner mandrel at the other end of said passage; and wherein said means for selectively diverting hydraulic fluid and pressure to said inner mandrel and inside said outer piston comprises a selectively closable primary port through which said hydraulic fluid primarily flows during normal operation, said primary port being selectively closable to divert all hydraulic fluid and pressure to said passages communicating with said inner mandrel and inside said outer piston.

16. The hydraulic lift apparatus of claim 15 wherein said means for removing hydraulic pressure from said inner mandrel and from inside said outer piston comprises at least one passage communicating said bypass passages to the interior of said outer tube of said drill string, said passage being closed by a burst disk until a predetermined pressure has been achieved, said burst disk then failing and opening said passage to thereby draw hydraulic fluid and pressure from said bypass passage into said outer tube and from said inner mandrel and from inside said outer piston.

17. An apparatus for hydraulically lifting an inner tube, said inner tube concentrically disposed within an outer tube in a drill string, said apparatus comprising:

first means for longitudinally lifting said inner tube within said outer tube; and second means for selectively diverting hydraulic pressure and flow within said outer tube from normal flow and pressure patterns to said first means, said first means lifting said inner tube in response to said selectively diverted hydraulic pressure and flow, said second means then selectively and automatically rediverting said hydraulic pressure and flow away from said first means when a predetermined magnitude of pressure is achieved, whereby said inner tube is selectively longitudinally displaced upward within said apparatus without causing substantial cessation of hydraulic flow within said apparatus.

18. A hydraulic lift apparatus for use in combination with a drill string and coring bit, said drill string being characterized by including an outer tube connected to a coring bit and having pressurized hydraulic fluid forced through said outer tube, said drill string further characterized by an inner tube for receiving and lifting a core cut by said core bit, said hydraulic fluid generally flowing between said outer and inner tube to said core bit, said hydraulic lift apparatus comprising:

an inner mandrel longitudinally fixed and coupled to said outer tube and concentrically disposed within said outer tube;

an outer piston disposed within said outer tube and concentrically disposed in telescopic relationship about said inner mandrel, said outer piston being selectively longitudinally fixed with respect to said inner mandrel and hence said outer tube, said outer piston being connected to said inner tube;

first means for diverting hydraulic fluid flow and static pressure to said inner mandrel and inside said outer piston, said outer piston being responsive to hydraulic fluid flow and static pressure supplied to inside said outer piston to be longitudinally displaced upwardly with respect to said inner mandrel, thereby lifting said inner tube connected to said outer piston upwardly within said outer tube; and second means for automatically rediverting said hydraulic fluid flow and static pressure to said coring bit upon achievement of a predetermined pressure, whereby said hydraulic lift apparatus is included within said drill string for selectively lifting said inner tube within said drill string to facilitate coring.

* * * * *